US007261460B2

(12) United States Patent
Frey

(10) Patent No.: US 7,261,460 B2
(45) Date of Patent: Aug. 28, 2007

(54) INTERCHANGEABLE CLOCK HAVING THE APPEARANCE OF A FLOOR CLOCK AND KITS FOR PROVIDING SAME

(76) Inventor: Peter R Frey, 117 Green St., Apt. 1, Syracuse, NY (US) 13203

( * ) Notice: Subject to any disclaimer, the term of this patent is extended or adjusted under 35 U.S.C. 154(b) by 311 days.

(21) Appl. No.: 10/692,531

(22) Filed: Oct. 24, 2003

(65) Prior Publication Data

US 2005/0088919 A1 Apr. 28, 2005

(51) Int. Cl.
*G04B 37/00* (2006.01)

(52) U.S. Cl. ..... 368/276; 368/10; 368/316

(58) Field of Classification Search ..... 368/276, 368/278, 316, 317, 10, 327; 248/114, 115, 248/116; D10/1, 6, 16; 206/18, 301
See application file for complete search history.

(56) References Cited

U.S. PATENT DOCUMENTS

| | | | | | |
|---|---|---|---|---|---|
| 1,535,085 | A * | 4/1925 | Bamberger | ..... | 248/115 |
| D71,345 | S | 10/1926 | Sokol et al. | | |
| 1,815,796 | A * | 7/1931 | Prevost | ..... | 368/316 |
| 3,416,761 | A * | 12/1968 | Shanok et al. | ..... | 248/115 |
| 4,028,842 | A * | 6/1977 | Adams | ..... | 206/301 |
| 4,047,822 | A * | 9/1977 | Lehmann | ..... | 403/187 |
| 4,310,908 | A | 1/1982 | Fuerneisen | | |
| 4,491,425 | A | 1/1985 | Young-Koo | | |
| 4,624,579 | A | 11/1986 | Forman | | |
| 5,036,501 | A * | 7/1991 | Smith | ..... | 368/88 |
| 5,216,642 | A | 6/1993 | Rikkers | | |
| 5,610,877 | A | 3/1997 | Adams et al. | | |
| 6,278,664 | B1 * | 8/2001 | Huffman et al. | ..... | 368/223 |
| 6,290,387 | B1 | 9/2001 | Chen | | |

* cited by examiner

*Primary Examiner*—Judy Nguyen
*Assistant Examiner*—Leo T. Hinze
(74) *Attorney, Agent, or Firm*—Burr & Brown

(57) ABSTRACT

The present invention provides an interchangeable clock and clock kits for making an interchangeable wall clock that has the appearance of being a free-standing floor clock. The interchangeable wall clock includes a mounting member, an interchangeable main body portion extending from the mounting member, a clock unit, and a base member. The main body portion is connected to the mounting member and the base member with a quick-release connection mechanism to facilitate easy interchangeability. Interchangeable façades are provided for the mounting member, the base member and the clock-face substrate of the clock unit. The clock kit contains various combinations of the above-described components of the interchangeable wall clock.

23 Claims, 4 Drawing Sheets

INTERCHANGEABLE CLOCK HAVING THE APPEARANCE OF A FLOOR CLOCK AND KITS FOR PROVIDING SAME

FIELD OF THE INVENTION

The present invention relates to an interchangeable clock that is mounted on a vertical surface, such as a wall, but has the appearance of being a free-standing floor clock, and kits for making the interchangeable clock.

BACKGROUND OF THE INVENTION

Long-case clocks and tall-case clocks are historically known as floor clocks, and are commonly referred to as grandfather clocks by general consumers and horologists alike. "Grandmother clocks" are also floor clocks, but are typically shorter than 77" and are often made in a cherry finish. "Granddaughter clocks" are an even shorter member of the grandfather clock family.

Long-case clocks were first produced circa 1660 in England, driven by the 1657 invention of the long pendulum that required a long case. Thus, the pendulum that created a breakthrough in time keeping accuracy also introduced a new and unique form of furniture. The earliest long-case clocks were made in London for royalty or nobility, and these early clocks were both esthetically pleasing and horologically desirable. Each long-case clock component typically holds reliable indicia of the era in which the clock was originally designed to be as appealing as possible to its initial owner, in accord with the trends for the furniture, fabrics, porcelains and silver of that time. Fine clocks crafted by the most noted makers from 1660–1730 are now around 300 years old, and clocks made by early pioneers such as Tompion and Knibb commonly sell today for well over $500,000.

Over time, the production of long-case clocks expanded, and such clocks became more widely available as manufacturers found ways to reduce the cost of long-case clocks to meet a wider market. Today, younger clocks typically have lower prices than their older counterparts. Still, grandfather clocks are expensive furnishings and are often referred to as an "investment piece" or an "heirloom" piece.

Grandfather clock cabinets are crafted from fine hardwoods with a variety of finishes and veneers including oak (Yorkshire and Golden), cherry (heirloom, Merlot, Shaker, Windsor, Americana, Hampton), mahogany, walnut, carved shell overlays, glossy lacquers, antiqued, satin and metallic finishes. The clock faces can be metal-cast, pressed, carved or otherwise formed from a variety of materials and decorated with embellishments, while clock hardware, pendulums, and other essential components are made from brass, nickel and other suitable metals. Despite the fact that the costs of grandfather clocks have fallen such that they are no longer reserved solely for an elite noble class, long-case clocks typically cost between $700 and $10,000, with an average cost of about $3000.

One available option is to purchase a grandfather clock kit that includes all the parts from which the owner can assemble a long-case clock. The kits are designed for all levels of skill, from sets of plans that merely contain detailed descriptions of how to make a clock from scratch to kits that include all of the pieces required for complete assembly, including pre-cut moldings and glass, and that usually only require a screwdriver or wood glue to complete. Even the kits designed for the less skilled hobbyist include an extensive number of parts, however, and the kits can be contained in as many as five or six separate cartons. Further, while some grandfather clock kits offer a more affordable alternative to pre-assembled long-case clocks, many kits can cost as much as, or even more than, pre-assembled long-case clocks themselves. For example, while some grandfather clock kits cost as little as $500, others can cost as much as $2500.

Grandfather clocks typically measure between 78 and 95 inches tall, 15–40 inches wide and 10–15 inches deep. The size, substantial weight, and relative delicacy of the horological components (i.e., working clock parts) limit the ability to rearrange grandfather clocks. Once the clock is positioned in a room, it is difficult to reposition. Moreover, most people find it desirable for the design elements of the clock to harmonize with the style and design elements of the room in which it is featured. If an owner intends to refurbish a room while retaining the presence and position of the clock, the design elements of the clock may play a greater role in, or even dictate, the room redesign scheme.

That is, while the style and classic beauty of grandfather clocks are indeed timeless, today's decorating and interior design trends demand more flexibility, even from the design elements themselves. While sofas or chairs can be reupholstered and tables refinished, however, an heirloom piece like a long-case grandfather clock is designed to remain unchanged by the trends of time. Yet a long-case clock can still be a stunning design element even among the trendiest of contemporary styles.

Thus, it would be desirable to provide an adaptable, affordable horological design element that could be featured in a room in the same manner as a traditional long-case clock, but which could also be easily moved to a different location within a room or to another room. It would be desirable to provide a wall clock having the appearance of a free-standing long-case clock, that has adaptable features that allow owners to change the overall appearance of the clock based on their personal design needs, and that offers the interchangeable design flexibility of providing timeless elegance or trendy style. It would also be desirable to provide a clock that could be assembled or disassembled from few pieces in a few quick and easy steps for storage, transport, sales presentation or shipping purposes. Further, it would be desirable to provide an interchangeable clock having the appearance of a free-standing floor clock that is available as a kit including one, two or more different design element options. It would also be desirable to provide other accessory kits to offer extended design options beyond the basic kit selections.

SUMMARY OF THE INVENTION

It is an object of the present invention to provide an attractive and affordable time piece that can be featured in a room in the same manner as a traditional long-case clock, but which can also be easily repositioned within the room or moved to another room. It is another object of the present invention to provide an easily repositionable wall clock that has the appearance of a free-standing long-case clock. Another object of the present invention is to provide a clock having adaptable features that allow owners to change the overall appearance of the clock based on their personal design needs and that offers the design flexibility of interchangeably providing timeless elegance or trendy style. Yet another object of the present invention to provide a clock that can be assembled from a few pieces or disassembled in a few quick and easy steps for storage, transport, sales presentation or shipping purposes. Further, it is also an object of the present invention to provide a clock kit including one, two or more different design element options and to provide other accessory kits that offer extended design options beyond the basic kit selections.

According to one embodiment of the present invention, a clock kit is provided, including a mounting member adapted to be fastened to a vertical mounting surface in a position that is spaced a predetermined distance from an intersection of the vertical surface and a horizontal surface. The clock kit also includes at least one interchangeable main body portion adapted to extend from the mounting member toward the horizontal surface such that the main body portion gives the appearance of being a central portion of a free-standing clock, and a clock unit adapted to be supported at a fixed position with respect to the mounting member and the main body member.

Preferably, the clock kit further includes a base member adapted to be arranged in a position substantially aligned with the mounting member such that the mounting member, the main body portion, the clock unit and the base member give the appearance of being an integrated, free-standing clock. It is also preferred that the clock kit includes at least one interchangeable mounting member façade. In a preferred embodiment, the main body portion is flexible, however, a substantially rigid main body portion may be provided, as well.

The clock unit at least includes a driving mechanism, a clock-face substrate, a plurality of clock hands, at least one interchangeable clock-face façade adapted to be secured to the clock-face substrate, and means for supporting the clock unit at the fixed position with respect to the mounting member and the main body portion. According to one embodiment of the present invention, the means for supporting the clock unit at the fixed position with respect to the mounting member and the main body portion comprises a hook member adapted to extend from the mounting member and a corresponding loop member positioned on a rear surface of the clock-face substrate.

According to another embodiment, the means for supporting the clock unit comprises magnetic means including, for example, an elongate member adapted to extend from the mounting member. According to one aspect, the elongate member comprises a metal, and at least one magnet is provided on a portion of the rear surface of the clock-face substrate to facilitate a magnetic connection. According to another aspect, the elongate member comprises at least one magnet configured on a surface thereof, and at least a portion of the rear surface of the clock-face substrate is metal, or the rear surface of the clock-face substrate includes a corresponding configuration of receiver magnets to facilitate a magnetic connection.

The at least one main body portion of the clock kit preferably comprises a plurality of different main body portions each having a pattern, color, texture or design on at least a front surface thereof. It is also preferred that at least one of the plurality of main body portions has a pattern, color, texture or design on a rear surface thereof such that the at least one man body portion is reversible. The material of the at least one main body portion can be at least one of any material selected from the group consisting of textiles, papers, cardboards, plastics, metal fabrics, natural fiber woven materials, ceramic woven fibers, metal sheets and wood sheets.

Preferably, a portion of the means for supporting the clock unit passes through an opening in the main body portion, such that the clock-face substrate resides on the front surface of the main body portion. The clock kit also preferably includes an interchangeable pendulum member adapted to extend from the clock unit to assume a position with respect to the front surface of the main body portion.

According to another embodiment of the present invention, the clock kit further includes an accessory kit. The accessory kit includes at least one interchangeable façade adapted to be positioned on the mounting member, at least one interchangeable façade adapted to be positioned on the clock face substrate, and at least two main body portions each having a distinct, predetermined pattern, color, texture or design at least on a front surface thereof. Preferably, the accessory kit further includes an interchangeable pendulum member adapted to extend from the clock unit to assume a position with respect to the front surface of the main body portion, and at least one interchangeable façade adapted to be positioned on the base member.

According to another embodiment of the present invention, a clock is provided, including a mounting member adapted to be fastened to a vertical mounting surface at a predetermined distance from the floor, an interchangeable main body portion extending from a first end proximate the mounting member toward an opposed second end proximate the floor and defining a height of the main body portion, such that the main body portion gives the appearance of being a central portion of a free-standing floor clock, and a clock unit supported in a fixed position with respect to the mounting member and the main body member. It is also preferred that the clock according to present invention includes a base member positioned on a horizontal surface in a position substantially aligned with the second end of the main body portion. Preferably, the mounting member includes at least one quick-release connection mechanism for securing the main body portion to the mounting member, and the base member includes at least one quick-release connection mechanism for securing the main body portion to the base member.

According to yet another embodiment of the present invention, a clock is provided, including a mounting member adapted to be fastened to a vertical mounting surface at a predetermined distance from the floor and an interchangeable main body portion extending from a first end proximate the mounting member toward an opposed second end proximate the floor and defining a height of the main body portion, such that the main body portion gives the appearance of being a central portion of a free-standing clock. A first quick-release connection mechanism for securing the first end of the main body portion to the mounting member is also provided. A clock unit that is supported in a fixed position with respect to the mounting member and the main body member, is also included, and the clock unit preferably includes at least a driving mechanism, a clock-face substrate, a plurality of clock hands, and means for supporting the clock unit at the fixed position with respect to the mounting member and the main body portion. Further, a base member is provided, positioned on a horizontal surface in a position substantially aligned with the mounting member, as well as a second quick-release connection mechanism for securing the second end of the main body portion to the base member.

BRIEF DESCRIPTION OF THE DRAWINGS

For a more complete understanding of the nature and objects of the present invention, reference should be made to the following detailed description of a preferred mode of practicing the invention, read in connection with the accompanying drawings, in which:

FIGS. 1A–1D are schematic diagrams of an interchangeable clock having the appearance of being a free-standing floor clock according to one embodiment of the present invention, wherein FIG. 1A is a front view, FIG. 1B is a left-side view, FIG. 1C is a top view and FIG. 1D is a bottom view;

FIG. 2 is an exploded view of the interchangeable clock of FIG. 1A;

DETAILED DESCRIPTION OF THE INVENTION

Figure 1A:
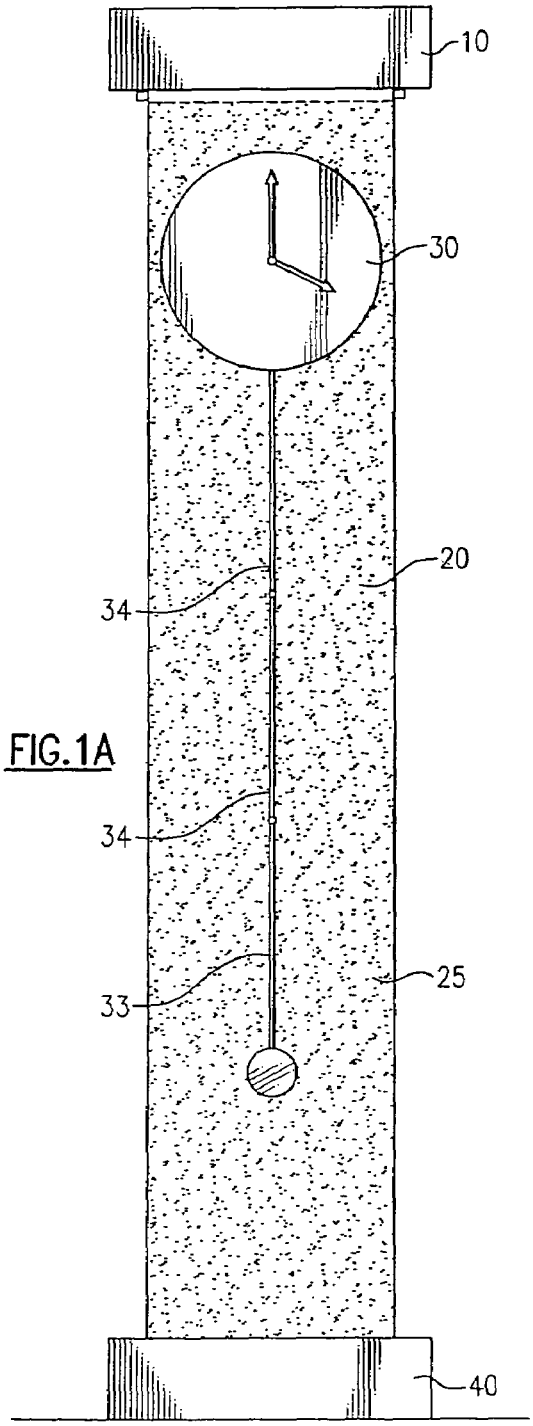
Figure 1B:
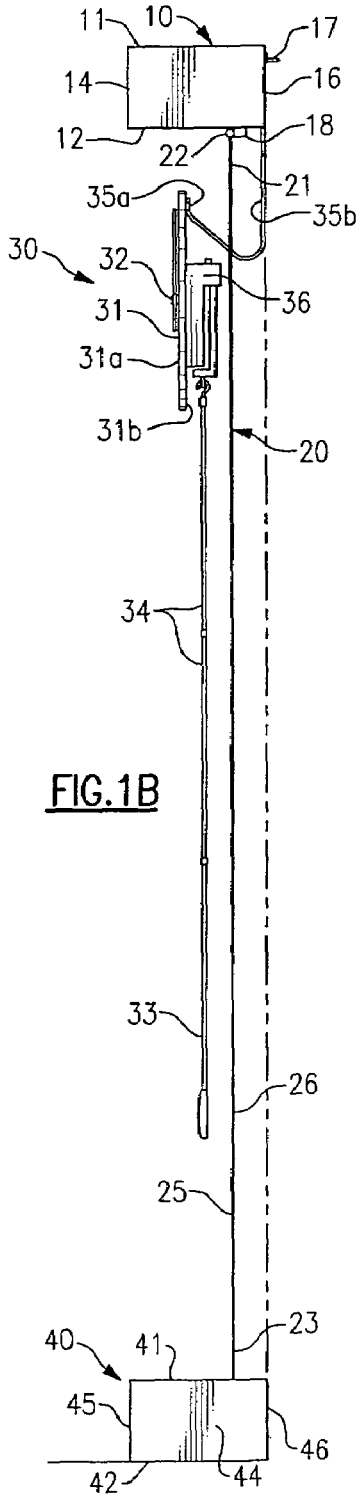
Figures 1C, 1D, 2:
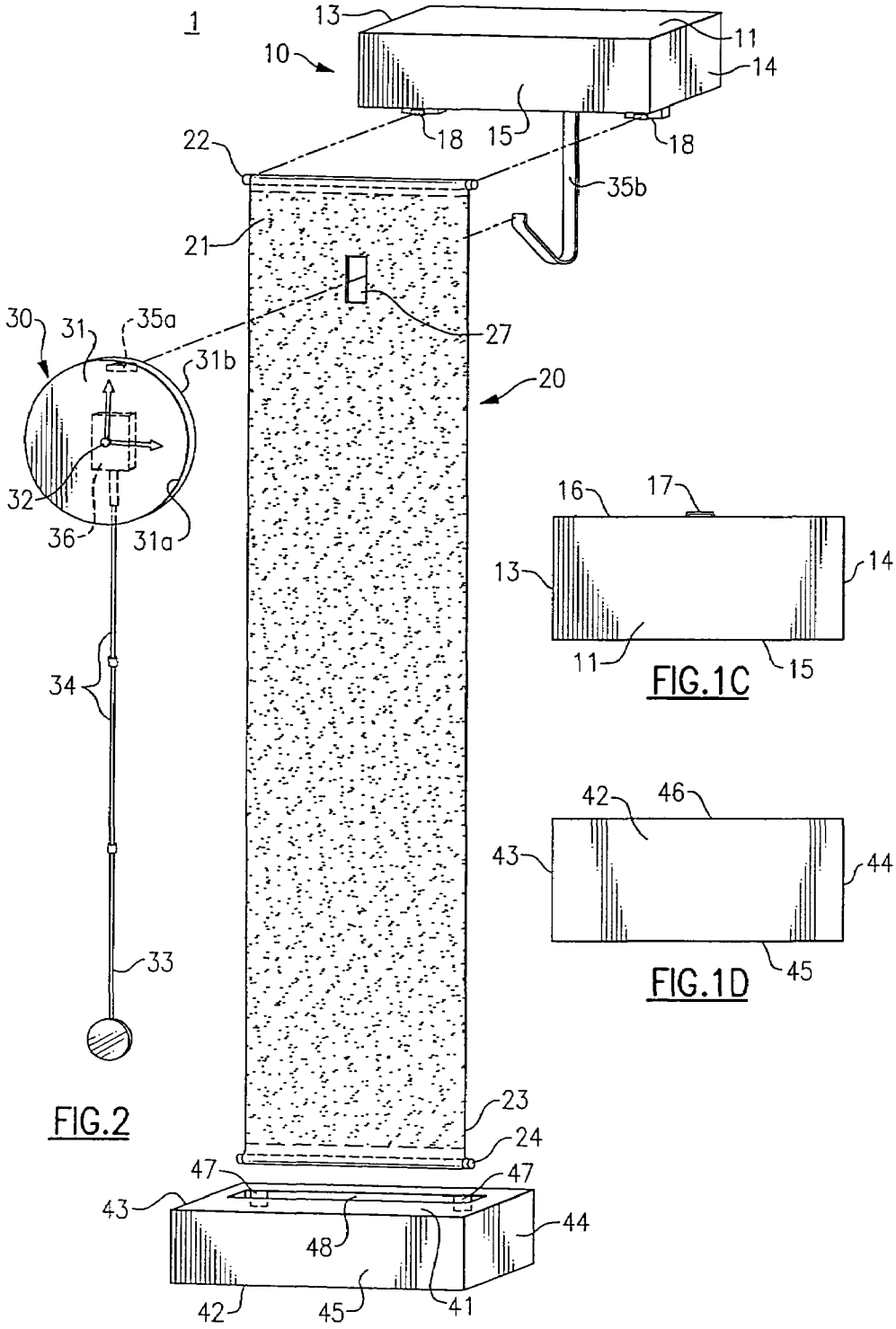

FIGS. 1A–1C are schematic views of an interchangeable wall clock having the appearance of being a free-standing floor clock according to one embodiment of the present invention. The basic, general structure of an interchangeable clock according to the present invention is shown in the front view of FIG. 1A and the left-side view of FIG. 1B, which are best understood when read in connection with the exploded view shown in FIG. 2. It should also be noted that the right-side view is essentially a mirror image of the left-side view of FIG. 1B.

The mounting member 10 of the present invention is merely depicted as a block in the drawings having an upper surface 11, a lower surface 12, a pair of opposed side surfaces 13, 14, a front surface 15 and a rear surface 16. It should be noted, however, that the exact shape of the mounting member 10 is not critical, and the mounting member 10 can include a variety of embellishments, contours, filigrees, moldings and the like without departing from the spirit of the present invention. The materials for the mounting member 10 are not limited and the mounting member 10 can be made from any suitable material including, but not limited to, wood, particle board, plaster, plastics, heavy-duty paper or laminated cardboard, ceramic or the like.

The mounting member 10 also includes a means for mounting to a vertical surface, such as a wall, in the form of the fixation member 17. Fixation member 17 can be one or more of any type of fixation device including, but not limited to nails, tacks, screws, hook and wire mechanisms, and the like, so long as it is sufficient to at least support the weight of the mounting member 10, main body portion 20 and the clock unit 30.

A quick-release connection mechanism 18 is provided on the mounting member 10. As shown in FIGS. 1A, 1B, and 2, the quick-release connection mechanism 18 is positioned to extend at least slightly from the lower surface 12 of the mounting member 10. The quick-release connection mechanism 18 can be made of one or more magnets, a metal member, hooks, buttons, snaps, loops, a portion of a hook-and-loop type fastener, or the like. Alternately, the quick-release connection mechanism 18 can be formed as a dowel-receiving socket on the lower surface 12 of the mounting member 10.

A main body portion 20 is provided, suspended form the mounting member 10. The first end 21 of the main body portion 20 is connected to the quick-release connection mechanism 18 of the mounting member 10 via a corresponding quick-release connection mechanism 22. The corresponding quick-release mechanism 22 can be a thin metal rod that is inserted into a pocket seam or sewn into a seam of the main body portion proximate the first end 21 thereof, as shown in FIG. 2, for example.

The exact type of connection mechanism used for the corresponding quick-release mechanism 22 is not critical, so long as it corresponds to the quick-release mechanism 18 provided on the mounting block 10 and so long as it is, in fact, quick releasing. For example, the corresponding quick-release mechanism 22 could also be one or more small magnets that are either provided on the second (rear) surface 26 of the main body portion 20 or that are sewn into a pocket seam or otherwise fixed to the main body portion 20 proximate the first end 21 thereof. The corresponding quick-release connection mechanism 22 could be a portion of a hook-and-loop type fastener that is fixed to the second (rear) surface 26 of the main body portion 20. The corresponding quick-release connection mechanism 22 could likewise be one or more hooks, snaps, button-holes or loops, depending on the configuration of the quick-release connection mechanism 18. Alternately, the corresponding quick-release mechanism 22 could be a dowel or rod member attached to the first end 21 of the main body portion 10.

The main body portion 20 shown in FIGS. 1A and 1B has an elongate shape having a length that is substantially greater than a width thereof. The shape of the main body portion 20 is not limited to the rectangular shape shown in FIGS. 1A and 1B, for example, but the lateral edges and the first and second ends 21, 23 can be formed to have any contour, silhouette or shape to accomplish the desired design. In a preferred embodiment, however, the clock 1 maintains the appearance of being a free-standing floor clock no matter what the design particulars of the main body portion may be.

It should be noted, however, that the interchangeable clock 1 of the present invention can also be scaled down in size to resemble a mini-floor clock positioned on a shelf, for example. That is, the size of the interchangeable clock 1 according to the present invention is not limited to a grandfather-sized (i.e., greater than 77 inches tall), long-case type clock. As described in more detail below, the base of the clock could also be wall-mounted, either close to or spaced apart from the floor, depending on the particular design choices of the owner.

The main body portion 20 can be made from any type of material that provides the desired drape when the main body portion 20 is connected to the mounting member 10 as shown in FIGS. 1A and 1B. It is preferred that the main body portion 20 has a very small thickness dimension. As shown in FIG. 1B, the thickness of the main body portion 10, or the distance between the front surface 25 and the rear surface 26 thereof, is essentially the width of a single strip of fabric, for example. It should be noted, however, that the thickness is not limited to the embodiment shown in the drawings.

It is also preferred that the material of the main body portion 20 be sufficiently flexible such that the main body portion 20 can be manipulated into a variety of configurations without damaging the appearance of the main body portion in an un-manipulated, (i.e., flat or hanging) state. It should be noted, however, that the main body portion 20 can also be a substantially rigid member, such as cardboard covered in fabric, for example. The main body portion 20 can have any type of design, pattern, texture or color on one or both of the front 25 and rear 26 surfaces thereof, such that the main body portion 20 is reversible. These features of the main body portion 20 are described in more detail below in connection with the clock kit of FIG. 3 and the accessory kit shown in FIG. 4.

The clock unit 30 includes a clock-face substrate 31 having a front face surface 31*a* and a rear surface 31*b*. A driving member 36 is provided on the rear surface 31*b* of the clock-face substrate, and a pendulum extension 34 extends from the driving member 36. A pendulum 33 is positioned on the terminal end of the pendulum extension 34. The pendulum can be made from any suitable material, including wood, metals, alloys, composite materials, ceramics, weighted papers or cardboards, beads, acorns and assorted baubles or the like. It should be noted, however, that a pendulum may not be a functional requirement for the clock unit 30, which can be battery or AC operated, wound, gear-driven or otherwise supplied with sufficient means to operate the time keeping mechanism.

While the clock unit 30 shown in FIGS. 1A–1B is a simple design, the clock-face substrate 31 can have any shape or any size. The particulars are dictated only by the desires of the designer. Further, the clock unit 30 can feature other aesthetic amenities, such as chimes, a cuckoo-style signal, or other auditory enhancements.

As shown in FIG. 1B and FIG. 2, means for supporting the clock unit 30 at a fixed distance with respect to the mounting member 10 and the main body portion 20 is provided in the form of a loop 35*a* positioned on the rear surface 31*b* of the clock-face substrate 31 that mates with the hook member 35*b* extending from a portion of the lower surface 12 of the mounting member 10. A portion of the hook member 35*b* extends through an opening 27 (see FIG. 2) provided in the main body portion 20 from the second surface 26 thereof toward the first surface 25 thereof such that the clock unit 30 is essentially mounted on the first surface 25 of the main body portion 20 as shown in FIGS. 1A and 1B.

Figure 5:
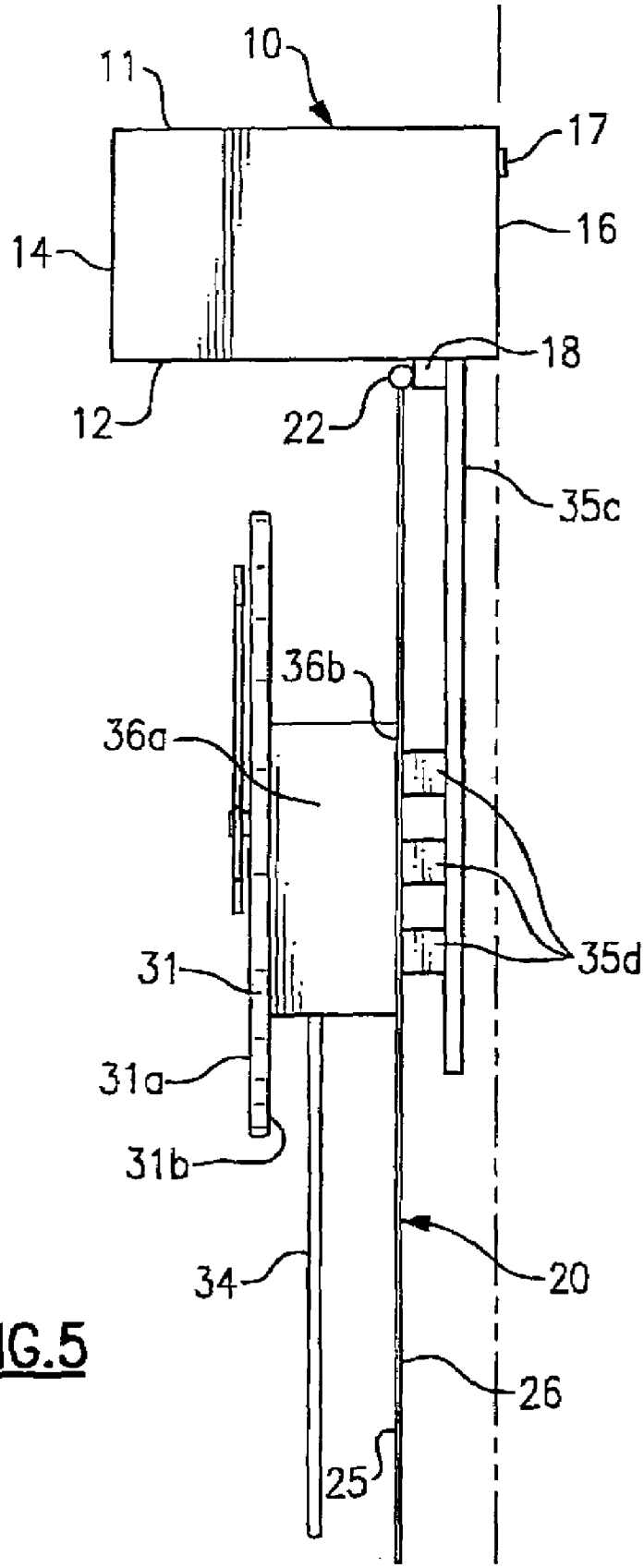
FIG. 5 is a partial side view of another embodiment of an interchangeable clock according to the present invention.

As shown in the partial side view of FIG. 5, means for supporting the clock unit 30 at a fixed distance with respect to the mounting member 10 and the main body portion 20 is provided, in part, in the form of an elongate bar 35*c* that extends from a portion of the lower surface 12 of the mounting member 10. The elongate bar 35*c* includes a plurality of magnets 35*d* on a surface thereof that is immediately adjacent the rear surface 26 of the main body portion 20. In addition, a box 36*a* is provided on the rear surface 31*b* of the clock-face substrate, surrounding the driving mechanism 36. A surface 36*b* of the box 36*a* immediately adjacent the front surface 25 of the main body portion 20 is made of metal to mate with the magnets 35*d* on the elongate bar 35*c*, such that a magnetic connection can be securely achieved, even with the main body portion 20 interposed between the metal surface 36*b* of the box 36*a* and the magnets 35*d*. In that manner, there is no need to provide an opening 27 in the main body portion 20, which decreases the degree of precision required to manufacture the main body portion 20, and in turn, reduces the cost. Additionally, the embodiment shown in FIG. 5 also enables faster assembly and interchangeability of the components of the clock 1.

Although it is not shown in FIG. 5, the surface 36*b* of the box 36*a* could also be provided with a corresponding number of receiver magnets to facilitate another type of magnetic connection in addition to the connection described above. It will be understood by those skilled in the art that the magnets should have sufficient strength and a sufficient arrangement to support the clock unit 30 and prevent any positional shifting despite the motion of the pendulum 33.

The means for supporting the clock unit 30 could also include one or more hook members provided on a portion of the surface 36*b* of the box 36*a* shown in FIG. 5, for example. That is, in lieu of the magnetic means described above, the hooks extend outwardly a short distance and then a distance downwardly from the surface 36*b*, such that the hooks pierce the material (e.g., fabric) of the front surface 25 of the main body portion 20 to fasten the clock unit 30 in place. It should be noted that such a hook means for supporting the clock unit 30 is preferably used in connection with a main body portion 20 that includes a substantially rigid support portion and a flexible covering portion, such as cardboard covered in fabric, for example. While this embodiment is not shown in the drawings, it will be understood by those skilled in the art that this variation, along with other variations, can be made without departing from the scope and spirit of the present invention.

It should also be noted, however, that the clock unit 30 could instead be fastened directly to the same vertical surface (i.e., wall) as the mounting member 10 by providing a fixing member, for example, a hook, nail, screw, or other suitable projection-type fixing member, that is fixed to the wall at a predetermined position with respect to the fixed mounting member 10. In that manner, the fixing member would pass through the opening 27 from the second surface 26 of the main body portion 20 and mate with the loop 35*a* provided on the rear surface 31*b* of the clock-face substrate 31 in a similar manner as the hook 35*b*. Additionally, a fixing member such as those described above could also be directly provided on the rear surface 31*b* of the clock unit 30 to pass through the opening 27 from the front surface 25 of the main body portion 20 and affix the clock unit 30 directly to the wall.

The second end 23 of the main body portion 20 includes a second quick-release connection mechanism 24. Although the second quick-release connection mechanism 24 is shown as a thin metal rod provided in a seam pocket of the second end 23 of the main body portion in FIG. 2, the thin metal rod could also be provided directly on the second surface 25 of the main body portion 20, as well. It should also be noted that the second quick-release connection mechanism 24 could be one or more of any of the types of quick-release connection mechanisms described above with respect to the quick-release connection mechanism 18 and the corresponding quick-release connection mechanism 22.

A base member 40 is also provided. Like the mounting member 10, the base member 40 is merely depicted as a block having an upper surface 41, a lower surface 42, a pair of opposed side surfaces 43, 44, a front surface 45 and a rear surface 46. It should be noted, however, that the exact shape of the base member 40 is not critical, and can include a variety of aesthetic embellishments, contours, filigrees, moldings, pedestal feet or the like without departing from the spirit of the present invention. Suitable materials for the base member 40 are similar to those described above in connection with the materials for the mounting member 10. The base member 40 shown in FIGS. 1A and B is positioned on the floor, however, the base member 40 could also be positioned on a surface above the floor, such as a shelf, or spaced a distance from the floor and directly mounted on a wall in much the same manner as the mounting member 10.

A quick-release connection mechanism 47 that corresponds to the second quick-release connection member 24 on the second end 23 of the main body portion 20 is provided. As shown in FIG. 2, the quick-release connection mechanism 47comprises two magnets provided in a trench 48 formed on the upper surface 41 of the base member 40. At least a portion of the second end 23 of the main body portion 20 is received within the trough and secured in place with the corresponding quick-release connection mechanisms 24 and 47.

The top view and the bottom view shown in FIGS. 1C and 1D show that the interchangeable clock 1 requires little floor space, that is, only as much floor space as necessary to accommodate the base member 40. Further, the profile of the clock (best seen in FIG. 2), when viewed form the top and bottom, does not protrude beyond the boundaries established by the dimensions of the mounting member 10 and the base member 40, which can be varied depending upon the desired design.

Figure 3:
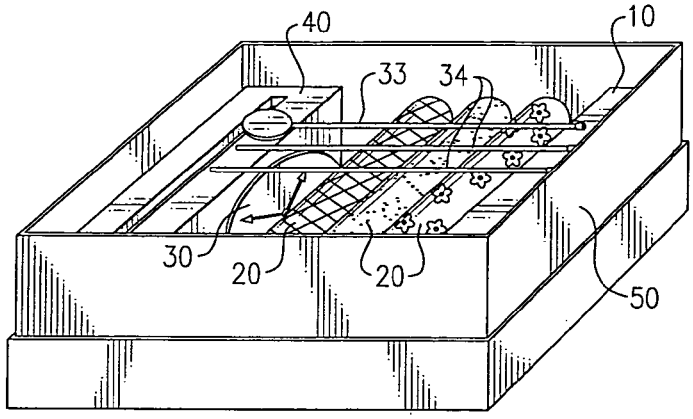
FIG. 3 is a perspective view of a clock kit according to one embodiment of the present invention.

FIG. 3 is a perspective view of a clock kit 2 according to one embodiment of the present invention. The clock kit 2 is positioned in an interior portion of a container, such as box 50. The dimensions of box 50 are limited only in that the length, width and height should be sufficient to accommodate at least the mounting member 10, at least one main body portion 20 (preferably in a compact form), a clock unit 30, pendulum 33, pendulum extensions 34, and any hardware, such as the hook member 35*b*, for example, that is required to assemble the interchangeable clock 1 from the clock kit 2. It should be noted, however, that while the clock kit 2 of FIG. 3 also includes a base member 40 and two additional main body portions 20, 20 that have been manipulated into a tubular configuration to conserve space, these items could instead be included in an accessory kit, such as accessory kit 3 shown in FIG. 4.

Figure 4:
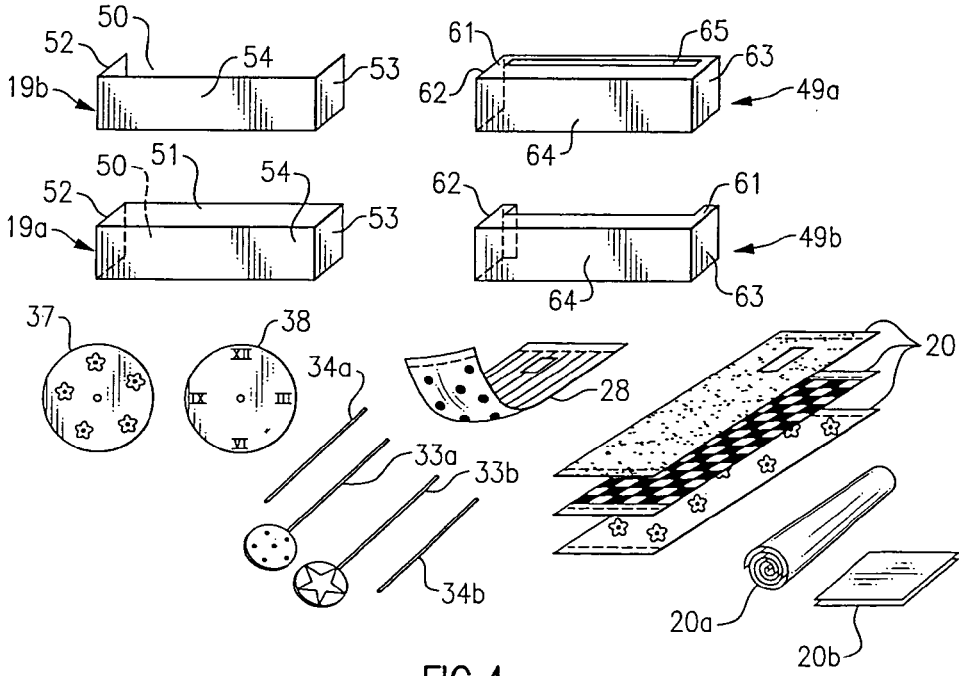
FIG. 4 is a schematic view of an accessory kit according to another embodiment of the present invention.

FIG. 4 is a perspective view of an accessory kit 3 according to another embodiment of the present invention. Accessory kit 3 includes two interchangeable mounting member façades 19*a*, 19*b* and two interchangeable base member facades 49*a*, 49*b*. It is preferred that the aesthetic design of the interchangeable mounting member façades 19*a*, 19*b* corresponds to a coordinating base member façade 49*a*, 49*b* to achieve the desired integrated look for the clock 1 when the façades are positioned on the mounting member 10 or the base member 40 of the clock 1 as described below.

As shown in FIG. 4, mounting member façade 19*a*, for example, is formed as a four-sided structure having a top side 51, a front side 54, a first side 52 that is joined to the top side 51 and the front side 54 at right angles, and an opposed second side 53 that is joined to the top side 51 and the front side 54 at right angles to define a space 50. As such, the façade 19*a* is essentially an elongate rectangular box that is missing a bottom side and a back side.

The façade 19*b*, however, is a three-sided structure including two opposing sides 52, 54 that are joined at right angles to a respective end of front side 54 to define a space 50. It should be noted, however, that the exact structures of the mounting member façades according to the present invention are not limited to the specific examples shown in FIG. 4. Any structure that will sufficiently cover the visible portions of the mounting block 10 can be used, including structures that involve intricate aesthetic features such as moldings, filigrees or the like.

As shown, the mounting member façade 19*a* is dimensioned to be positioned over the mounting member 10 such that the front surface 15 of the mounting member 10 is received with the space 50 defined by the first and second sides 52, 53, top side 51 and front side 54 of the façade 19*a*. In that manner, the upper surface 11, the front surface 15 and the side surfaces 13, 14 of the mounting member 10 will be covered by the façade 19*a*. The lower surface 12, and the rear surface 16 are not covered by the mounting member façade 19*a*, since these surfaces are not visually apparent when the clock 1 is mounted on a wall, for example.

The mounting member façade 19*b* is also dimensioned to be positioned over the mounting member 10 such that the front surface 15 of the mounting member 10 is received within a space 50 defined by the opposing sides 52, 53 and the front side 54 of the mounting member façade 19*b*. In that manner, the front surface 15 and the side surfaces 13,14 of the mounting member 10 will be covered by the façade 19*b*. The upper surface 11, the lower surface 12, and the rear surface 16 are not covered by the mounting member façade 19*b*, however, since those surfaces are not visually apparent when the clock 1 is mounted on a wall such that the distance from the floor to the upper surface 11 of the mounting member 10 is greater than about 72 inches.

The mounting member façades 19*a*, 19*b* can be secured to the mounting member 10 by any means including, but not limited to, corresponding pairs of grooves and pegs provided on the mounting member 10 and in the space 50 of the façades 19*a*, 19*b*, tabs, corresponding hook-and-loop type fasteners, or merely by virtue of a closely dimensioned press fit between the mounting member façades 19*a*, 19*b* and the mounting member 10 itself. The means by which the mounting member façades 19*a*, 19*b* are secured is not critical, so long as the connection is stable while still being substantially temporary enough to enable quick removal and facilitate easy interchangeability between façades 19*a* and 19*b*, for example, or between other façades having a similar structure to those of 19*a*, 19*b* that are not shown in FIG. 4.

The base member façades 49*a*, 49*b* shown in FIG. 4 have a similar structure described above in connection with the mounting member façade 19*a*. The top side 61 of the base member façade 49*a*, for example, further includes means, such as a cut-out portion or an opening 65, to provide access to the trench 48 in which the quick-release connection mechanism 47 is provided, even when the base member façade 49*a* is positioned to cover the base member 40. The base member façade 49*b* having a partial top side 61 is shown as another example of a base member façade. The exact structure of the base member façades 49*a*, 49*b* are not critical, so long as the desired portions of the base member 40 are properly covered to achieve the desired aesthetic appearance and so long as the quick-release connection mechanism 47 is accessible.

The base member façades 49*a*, 49*b* can be secured to the base member 40 in any manner similar to those described above in connection with securing the mounting member façade 19*a*.

The mounting member façades 19*a*, 19*b* and the base member façades 49*a*, 49*b* can be constructed from and decorated with any material that provides the desired aesthetic appearance. The façades are preferably interchangeable veneers or overlays made form natural woods, laminated woods, particle board-type composite materials, glass, plastics (e.g., acrylic, vinyl or other artificial materials) made to resemble wood, or plastic materials that do not resemble wood per se. The particular finish provided on the façades includes, but is not limited to, any variety of wood finish, metallic finish, mirrored finish, any variety or color of paint (e.g., antiqued, flat, glossy, hand-painted designs, etc.), patterned papers and acrylic overlays.

Clock-face façades 37, 38 are also included in the accessory kit 3 shown in FIG. 4. The clock-face façades 37, 38 are dimensioned to cover the front surface 31*a* of the clock-face substrate 31, and can be secured thereto by any suitable quick-release means. Such quick-release means include, but are not limited to, tabs provided around the periphery of the clock-face façade 37 or 38 that secure to the rear surface 31*b* of the clock-face substrate, hook-and-loop type fasteners (i.e., VELCRO®), or a rim provided around the periphery of the clock-face façade 37, 38 that provides a press fit about the outer periphery of the clock-face substrate 31.

The clock-face façades 37, 38 can have any shape, so long as the façades substantially cover the clock-face substrate 31, and the clock-face façades can have any type of numerical clock-face, or no numerical clock-face, provided on any type of pattern, design, color or texture. The materials used for the clock-face façades 37, 38 are not critical, so long as they are constructed to be light enough to be supported by the means for supporting the clock unit 30 at a fixed position from the mounting member 10, whether that means comprises a suspension means provided in connection with the mounting member 10 or a direct connection to the wall. Some examples of suitable materials for the clock-face façades 37, 38 include, but are not limited to, molded or otherwise formed plastic materials, wood (carved, painted, finished, un-finished), glass, mirror, light ceramic materials, metal sheets, or plates and fabric or paper covered cardboard (e.g., decoupage papers).

The accessory kit 3 shown in FIG. 4 also includes a plurality of main body portions 20, 20, 20. Each main body portion 20, 20, 20 has a different color, design pattern or texture provided on at least the front surface 25 thereof. For example, the main body portions 20 could be provided with a variety of seasonal themes and colors, sports themes and colors or collector themes, and the accessory kits could comprise a particular scheme or theme. Another example of a design option kit includes providing one or more of an opaque, translucent, or transparent main body portion having any color, pattern or no color (i.e., clear) or pattern, on which the consumer could apply their own personal decorations, including, but not limited to photographs, children's art work, pins, stickers, greeting cards, collector memorabilia, recipe cards, book marks, phone numbers, and the like.

Additionally, different patterns, colors, textures or designs could be provided on the rear surface 26 of any one or more of the main body portions 20, such as the main body portion 28 shown in FIG. 4, to provide a reversible main body portion 28.

The main body portions 20 can be made form any type of material that provides the desired drape when the main body portion 20 is connected to the mounting member 10 as shown in FIGS. 1A and 1B. It is also preferred that the material of the main body portion 20 be sufficiently flexible such that the main body portion 20 can be manipulated into a variety of configurations without damaging the appearance of the main body portion in an un-manipulated, (i.e., flat or hanging) state. For example, the main body portion 29*a* of FIG. 4 is rolled into a tubular configuration for placement in a container, such as the box 50 shown in FIG. 3. On the other hand, the main body portion 29*b* of FIG. 4 is shown in a folded configuration. In either case, or in what ever manner the main body portion 20 is manipulated, the manipulated size and shape should be smaller and more compact than the un-manipulated size and shape to better facilitate storage, shipping, packaged presentation for sale, and the like.

For the clock kit 2 and the accessory kit 3, the flexibility of the main body portion 20 is important in providing the most compact packaging options for presentation and storage. If metallic sheets are desired for the main body portion 20, however, those sheets could be divided into smaller pieces and linked, or provided with a means for linking, in a manner that likewise enables compact storage. In the case that a clock 1 according to the present invention is directly purchased in a partially-assembled state, however, and not as a part of a kit, the main body portion could be made of an un-divided metallic sheet, glass sheet, wood panel or the like extending from the mounting member 10 to the base member 40 to provide an integrated look.

Additional pendulum extensions 34*a*, 34*b* and additional pendulums 33*a*, 33*b* are also provided in the accessory kit shown in FIG. 4. The additional pendulums 33*a*, 33*b* preferably correspond to the theme and style of the kit, and in particular, correspond to the design of the mounting member façades and the base member façades included therein. The additional pendulums 33*a*, 33*b* can be made of any suitable material, including, but not limited to plated or un-plated nickel, brass, silver, gold, platinum, stainless steel, any variety of wood, any suitable plastic material, any suitable ceramic material, or any suitable composite material. The pendulums 33*a*, 33*b* can also feature any type of aesthetic design, color, pattern, texture or finish.

Though it is not shown in the drawings, the interchangeable clock 1 of the present invention can also be fabricated from a mounting member that is adapted to house a continuous roll of a material that includes a first part that extends toward and is looped around a means provided in an inner portion of the base member to comprise a continuous loop main body portion. The continuous loop main body portion is looped around a portion of the base member and a second part extends back up toward the mounting member, but is positioned behind the first part of the continuous loop main body portion so that it is not easily seen from the front of the clock. The material roll can include a plurality of main body portions in aesthetically different designs, patterns, colors and textures that are fixed end-to-end to form a continuous loop. The overall appearance of the clock can thus be changed by simply removing the clock unit and tugging the first part of the continuous loop main body portion until the desired pattern, color, design or texture spans the distance between the mounting member and the base member. Since the configuration is one of a continuous loop, the undesired portions are re-rolled in the means provided in the mounting member until another time for display is chosen.

While the present invention has been particularly shown and described with reference to the preferred mode as illustrated in the drawings, it will be understood by one skilled in the art that various changes in detail may be effected therein without departing from the spirit and scope of the invention as defined by the claims.

What is claimed is:

1. A clock kit, comprising:

a mounting member adapted to be fastened to a vertical mounting surface in a position that is spaced a predetermined distance from an intersection of said vertical surface and a horizontal surface;

at least one interchangeable main body portion having a first end adapted to be fastened to said mounting member and an opposed second end, said main body portion being adapted to extend downwardly from and beyond said mounting member toward said horizontal surface such that said main body portion does not substantially overlap said mounting member so as to give the appearance of being a central portion of a free-standing clock; and a clock unit adapted to be supported at a fixed position with respect to said mounting member and said main body portion so that said main body portion is interposed between said clock unit and said vertical mounting surface;

wherein said main body portion comprises a substantially flexible material selected from the group consisting of textiles, papers, cardboards, metal fabrics, natural fiber woven materials, and ceramic woven fibers, said main body portion exhibiting sufficient flexibility to allow said main body portion to be manipulated into a rolled configuration.

2. The clock kit of claim 1, further comprising a base member adapted to be arranged in a position substantially aligned with said mounting member such that said mounting member, said main body portion, said clock unit and said base member give the appearance of being an integrated, free-standing clock.

3. The clock kit of claim 2, further comprising an accessory kit, said accessory kit comprising:

at least one interchangeable façade adapted to be positioned on said mounting member;

at least one interchangeable façade adapted to be positioned on said clock face substrate; and at least two main body portions each having a distinct, predetermined pattern, color or design at least on a front surface thereof.

4. The clock kit of claim 3, wherein said accessory kit further comprises an interchangeable pendulum member adapted to extend from said clock unit to assume a position with respect to said front surface of said main body portion.

5. The clock kit of claim 3, wherein said accessory kit further comprises at least one interchangeable façade adapted to be positioned on said base member.

6. The clock kit of claim 1, further comprising at least one interchangeable mounting member façade.

7. The clock kit of claim 6, further comprising at least one interchangeable clock-face façade adapted to be secured to said clock-face substrate.

8. The clock kit of claim 6, wherein said means for supporting said clock unit at said fixed position with respect to said mounting member and said main body portion comprises a hook member adapted to extend from said mounting member and a corresponding loop member positioned on a rear surface of said clock face substrate.

9. The clock kit of claim 1, wherein said clock unit further comprises a driving mechanism, a clock-face substrate, a plurality of clock hands, and means for supporting said clock unit at said fixed position with respect to said mounting member and said main body portion.

10. The clock kit of claim 9, wherein a portion of said means for supporting said clock unit passes through an opening provided in said main body portion, such that said clock-face substrate resides on a front surface of said main body portion.

11. The clock kit of claim 1, wherein said means for supporting said clock unit at said fixed position with respect to said mounting member and said main body portion comprises magnetic means.

12. The clock kit of claim 11, wherein said magnetic means comprises a metal elongate member adapted to extend from a portion of said mounting member.

13. The clock kit of claim 12, wherein said magnetic means further comprises at least one magnet provided on a portion of a rear surface of said clock-face substrate.

14. The clock kit of claim 11, wherein said magnetic means comprises an elongate member adapted to extend from a portion of said mounting member, said elongate member comprising at least one magnet configured on a portion thereof.

15. The clock kit of claim 14, wherein said magnetic means further comprises one of a metal member provided on a portion of a rear surface of said clock-face substrate and a corresponding configuration of receiver magnets provided on a portion of said rear surface of said clock-face substrate.

16. The clock kit of claim 1, wherein said at least one main body portion comprises a plurality of different main body portions each having a pattern, color, or design on at least a front surface thereof.

17. The clock kit of claim 16, wherein at least one of said plurality of main body portions has a pattern, color, texture or design on a rear surface thereof such that said at least one man body portion is reversible.

18. The clock kit of claim 1, further comprising an interchangeable pendulum member adapted to extend from said clock unit to assume a position with respect to a front surface of said main body portion.

19. A clock, comprising:

a mounting member adapted to be fastened to a vertical mounting surface at a predetermined distance from the floor;

an interchangeable main body portion fastened to said mounting member and extending downwardly from and beyond said mounting member from a first end proximate said mounting member toward an opposed second end proximate the floor and defining a height of said main body portion, such that said main body portion does not substantially overlap said mounting so as to give the appearance of being a central portion of a free-standing clock; and a clock unit supported in a fixed position with respect to said mounting member and said main body portion, so that said main body portion is interposed between said clock unit and said vertical mounting surface;

wherein said at least one main body portion comprises a substantially flexible material selected from the group consisting of textiles, papers, cardboards, metal fabrics, natural fiber woven materials, and ceramic woven fibers, said main body portion exhibiting sufficient flexibility to allow aid main body portion to be manipulated into a rolled configuration.

20. The clock of claim 19, further comprising a base member positioned on a horizontal surface in a position substantially aligned with said second end of said main body portion.

21. The clock of claim 20, wherein said base member further comprises at least one quick-release connection mechanism for securing said main body portion to said base member.

22. The clock of claim 19, wherein said mounting member further comprises at least one quick-release connection mechanism for securing said main body portion to said mounting member.

23. A clock, comprising:

a mounting member adapted to be fastened to a vertical mounting surface at a predetermined distance from the floor;

an interchangeable main body portion having, a first end fastened to said mounting member and an opposed second end, said main body portion extending downwardly from and beyond said mounting member from said first end thereof proximate said mounting member toward said opposed second end thereof proximate the floor and defining a height of said main body portion, such that said main body portion does not substantially overlap said mounting member so as to give the appearance of being a central portion of a free-standing clock;

a first quick-release connection mechanism for securing said first end of said main body portion to said mounting member;

a clock unit supported in a fixed position with respect to said mounting member and said main body portion, said clock unit comprising at least a driving mechanism, a clock-face substrate, a plurality of clock hands, and means for supporting said clock unit at said fixed position with respect to said mounting member and said main body portion so that said main body portion is interposed between said clock unit and said vertical mounting surface;

a base member positioned on a horizontal surface in a position substantially aligned with said mounting member; and a second quick-release connection mechanism for securing said second end of said main body portion to said base member;

wherein said at least one main body portion comprises a substantially flexible material selected from the group consisting of textiles, papers, cardboards, metal fabrics, natural fiber woven materials, and ceramic woven fibers, said main body portion exhibiting sufficient flexibility to allow said body portion to be manipulated into a rolled configuration.

* * * * *